US009016536B2

(12) United States Patent
Ponti

(10) Patent No.: US 9,016,536 B2
(45) Date of Patent: Apr. 28, 2015

(54) DEVICE AND METHOD FOR SUPPLYING CONTINUOUS STRIPS TO A TRANSVERSAL CUTTING STATION OF THE STRIPS

(75) Inventor: Francesco Ponti, Cerbara-Citta'di Castello (IT)

(73) Assignee: C.M.C. S.r.l., Cerbara-Citta'di Castello (Perugia) (IT)

( * ) Notice: Subject to any disclaimer, the term of this patent is extended or adjusted under 35 U.S.C. 154(b) by 337 days.

(21) Appl. No.: 13/581,035

(22) PCT Filed: Mar. 14, 2011

(86) PCT No.: PCT/IB2011/051062
§ 371 (c)(1),
(2), (4) Date: Aug. 24, 2012

(87) PCT Pub. No.: WO2011/114282
PCT Pub. Date: Sep. 22, 2011

(65) Prior Publication Data

US 2012/0325884 A1 Dec. 27, 2012

(30) Foreign Application Priority Data

Mar. 16, 2010 (IT) ..... BO2010A0164

(51) Int. Cl.
*B65H 35/04* (2006.01)
*B65H 20/32* (2006.01)
*B65H 23/26* (2006.01)
*B65H 39/16* (2006.01)

(52) U.S. Cl.
CPC ..... *B65H 35/04* (2013.01); *B65H 20/32* (2013.01); *B65H 23/26* (2013.01); *B65H 39/16* (2013.01); *B65H 2301/121* (2013.01); *B65H 2301/31124* (2013.01); *B65H 2301/3121* (2013.01); *B65H 2301/4148* (2013.01); *B65H 2406/11* (2013.01); *B65H 2406/311* (2013.01)

(58) Field of Classification Search
CPC ..... B65H 20/32; B65H 35/04; B65H 39/16; B65H 23/26; B65H 2310/121; B65H 2301/31124; B65H 2301/3121; B65H 2406/11; B65H 2406/311
USPC ..... 226/4, 109, 118.1, 118.4; 242/615.21
See application file for complete search history.

(56) References Cited

U.S. PATENT DOCUMENTS

| | | | |
|---|---|---|---|
| 5,104,104 | A | 4/1992 | Mol |
| 5,775,562 | A | 7/1998 | Jungk et al. |
| 2004/0028448 | A1 | 2/2004 | Seiler et al. |

FOREIGN PATENT DOCUMENTS

| | | | |
|---|---|---|---|
| EP | 1741653 | A | 1/2007 |

OTHER PUBLICATIONS

International Search Report for PCT/IB2011/051062, Mailed Jun. 22, 2011, 2 pages.

*Primary Examiner* — William E Dondero
(74) *Attorney, Agent, or Firm* — William J. Sapone; Ware Fressola Maguire & Barber LLP

(57) ABSTRACT

The device (100) is destined to receive flanked continuous strips (1, 2) from an arrival line (L), and feed them towards a transversal cutting station (SR). The device (100) comprises: a basin (3), associated to a terminal part of the arrival line (L), destined to enable formation, in each of the strips (1, 2) of a free loop (A1, A2) in a downwards direction; deviator organs (4), at a 45° angle, provided downstream of the basin (3), destined to guide the strips (1, 2) such as to orientate them perpendicularly to the arrival direction, horizontally centered and correctly staggered in height such as to enter the transversal cutting station (SR).

18 Claims, 6 Drawing Sheets

DEVICE AND METHOD FOR SUPPLYING CONTINUOUS STRIPS TO A TRANSVERSAL CUTTING STATION OF THE STRIPS

TECHNICAL FIELD

The invention relates to the technical sector of automatic machines which operate on a strip of paper unwound from a reel.

DESCRIPTION OF THE BACKGROUND ART

The above-cited automatic machines comprise machines which have an unwinding station, from which the strip is guided to form a first loop buffer and then is fed towards a printing station, where at least a side of the strip is printed upon.

Normally the printing is organised according to a traditional page-setting with a standard format, for example A4 type, so that there will be a plurality of pages flanked according to the width of the strip, for example two or three, and a corresponding number of lines of pages along the development of the strip.

There is for this reason a need to separate each longitudinal line of pages from the ones flanked thereto and, thereafter, to separate the consecutive pages of each line, such as to perform subsequent operations, such as formations of collected stacks and packing thereof into envelopes.

For this reason, downstream of the printing station a first station is provided for longitudinal cutting, in which the longitudinal separation of the lines is performed, possibly together with a trimming operation; the organs of the first station operate with a continuous advancement of the strip.

The flanked strips in outlet are first guided to form relative second loop buffers and are then subjected to progressive deviation, in transversal directions, such that one is brought to above another, before entering, in this configuration, a second station for transversal cutting, provided further downstream.

The formation of the second loop buffers is made necessary both in order to unload the longitudinal tension from the lines before operating the lateral deviation on them, and also because the organs of the second cutting station operate with a step-advancement.

The lateral deviation of the lines, necessary for their superposing, inevitably generates asymmetric transversal tension in the paper (which is not extensible) that tend to cause the strips to swerve, which not uncommonly results in their tearing, with all the drawbacks connected to resetting the line.

The above drawback is more likely to occur when using light paper reels, with weight of 60 gr/m$^2$ instead of the traditional 80 gr/m$^2$.

The intermittent advancing of the strips can be differentiated according to the storing program between the pages of the various lines; if the stack to be formed is not an exact multiple of the number of lines present in the strip, one or the other line in inlet to the cutting station has to be selectively halted, possibly both in turn, such that only the pages destined thereto reach the store where the stack is formed, downstream of the cutters.

This situation can increase the stress forces on the strips and increase the possibility of tearing occurring.

The above-described conditions impose rather low working speeds, which negatively impact on production costs.

SUMMARY OF INVENTION

The aim of the present invention is therefore to provide a device and a method for supplying continuous strips to a transversal cutting station of the strips, which is designed such as to prevent the above transversal stresses from inducing paper tearing.

A still further aim of the invention relates to the desire to provide a device which, in accordance with the actuation of the method, is conformed such as to guarantee a regular functioning also in the presence of differentiated advancement of the strips.

A further aim of the invention is to provide a device based on a simple concept, which is not large in volume and is relatively inexpensive.

The above-indicated aims are attained by a device for feeding continuous strips to a transversal cutting station of the strips, which strips are supplied flanked on an arrival line, which comprises:

a basin, associated to a terminal part of the arrival line, designed to interrupt a continuity of a support plane on which the strips rest, such that each of the strips forms, by gravity, a free loop in a downwards direction in the basin;

deviator organs, located downstream of the basin, destined to guide each of the strips in order arrange the strip with a transversal orientation with respect to the arrival line, which a strip is horizontally centred with respect to the other strips and directed towards the transversal cutting station.

The invention also concerns a method for supplying the continuous strips to a transversal cutting station of the strips, the strips being supplied flanked on an arrival line, which comprises:

definition in each strip along the arrival line of a free loop trajectory orientated by gravity in a downwards direction;

guided deviation of each strip downstream of the loop for arranging each strip with a transversal orientation that is predetermined with respect to the arrival line in such that each strip is centred horizontally with respect to the other strips and directed towards a corresponding infeed of the transversal cutting station.

With the device, designed to actuate the method, the operations which switch the strips from flanked to superposed, at a predetermined distance from one another, such as to enter the transversal cutting station, are performed without any anomalous and asymmetrical transversal tensions arising; in this way uncontrolled swerving of the strips is avoided, as well as tearing of the strips.

The device and the method of the present invention thus make it possible also to use lightweight paper, in the order of 60 gr/m$^2$, without any problems arising; indeed it is possible to considerably increase operating velocity with respect to traditional systems, by more than 50%.

The simplicity of the method and consequently of the device actuating it guarantee regular functioning even in the presence of a differentiated advancement of the strips.

Other important positive aspects derive from the fact that the device, thanks to its simplicity, exhibits limited contents and costs.

BRIEF DESCRIPTION OF THE DRAWINGS

The following description relates to a preferred embodiment of the device as well as preferred actuation forms of the method, in accordance with what is set out in the claims and with the aid of the accompanying figures of the drawings, in which:

DESCRIPTION OF THE PREFERRED EMBODIMENTS

Figure 5:
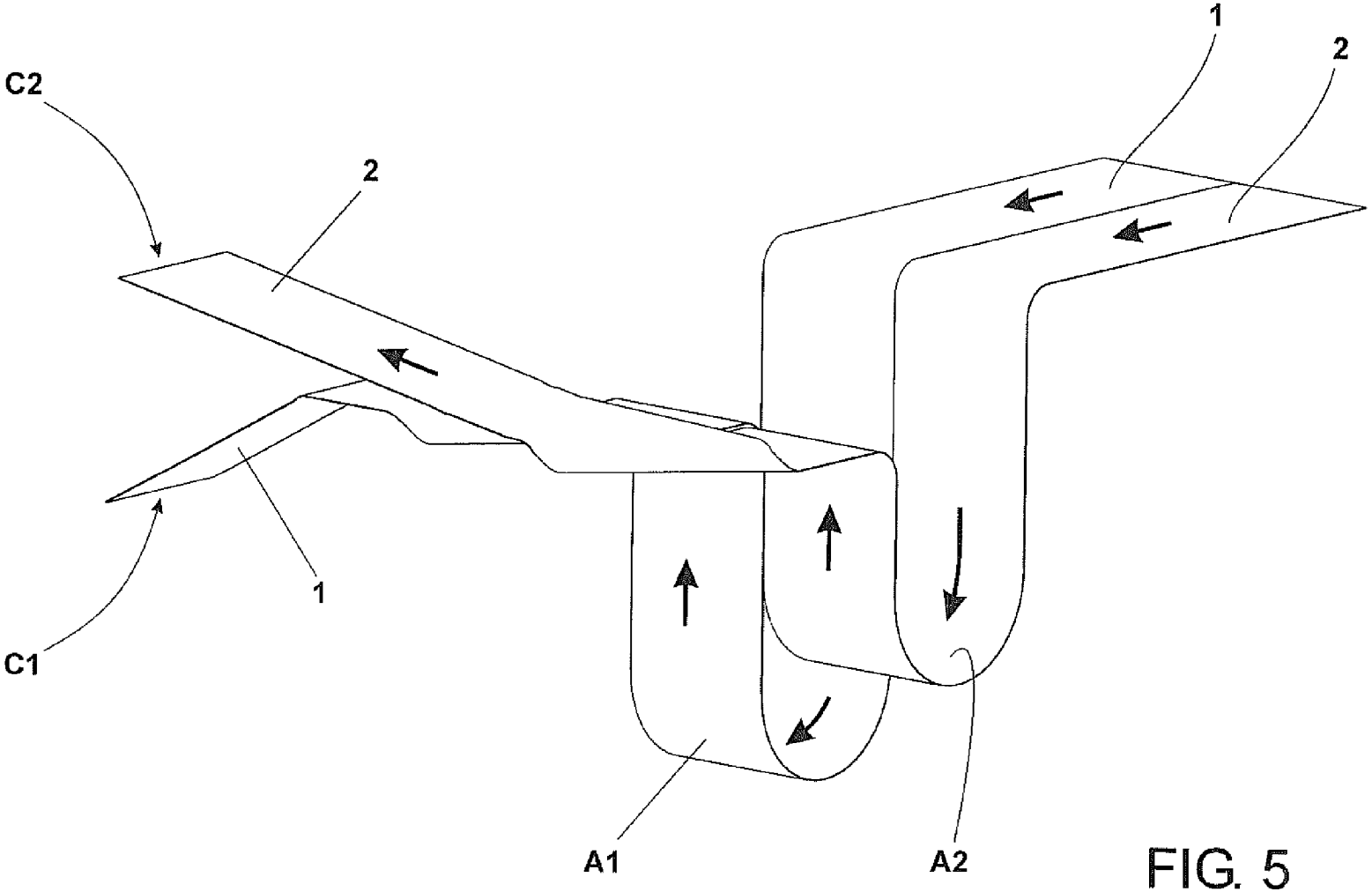
FIG. 5 schematically illustrates the trajectory followed by the paper strips internally of the device of the preceding figures.

With reference to figures from 1 to 4, 100 denotes in its entirety a preferred embodiment of the device of the invention, in accordance with a first preferred embodiment of the method, schematically illustrated in FIG. 5.

According to a known technique, at least two strips 1, 2, originating from a single reel, not illustrated, and from a preceding longitudinal cutting station, described in the preamble hereto (also not illustrated), are supplied flanked on an arrival line L.

The first embodiment of the method comprises:

definition in each strip 1, 2 along the arrival line L of a free loop trajectory orientated by gravity in a downwards direction;

guided deviation of each strip downstream of the loop for arranging each strip with a transversal orientation that is predetermined with respect to the arrival line L in such that each strip is centred horizontally with respect to the other strips and directed towards a corresponding infeed of the transversal cutting station.

An aerodynamic action is imposed on the free loops A1, A2, such as to push them downwards.

A depression is preferably generated in the zone underlying the loops A1, A2, such that the atmospheric pressure, insisting on the upper, gives rise to the downwards pushing action.

Alternatively, the same action can be obtained by injecting compressed air directed from above in a downwards direction, in the upper zone of the loops A1, A2.

The deviation is performed on the same side for both strips 1, 2, with an angle of 90° with respect to the arrival line L.

The method further comprises the strips 1, 2 being arranged vertically staggered in the tract preceding the entry thereof in the transversal cutting direction SR, in accordance with the positions of the relative inlet channel C1, C2.

The device 100 for actuating the described first embodiment of the method comprises, amongst other things:

a basin 3, associated to a terminal part of the arrival line L, designed to interrupt a continuity of a support plane on which the strips 1, 2 rest, such that each of the strips 1, 2 forms, by gravity, a free loop A1, A2 in a downwards direction in the basin 3;

deviator organs 4, located downstream of the basin 3, destined to guide each of the strips 1, 2 in order arrange the strip with a transversal orientation with respect to the arrival line L, which a strip is horizontally centred with respect to the other strips 1, 2 and directed towards the transversal cutting station SR.

Figure 1:
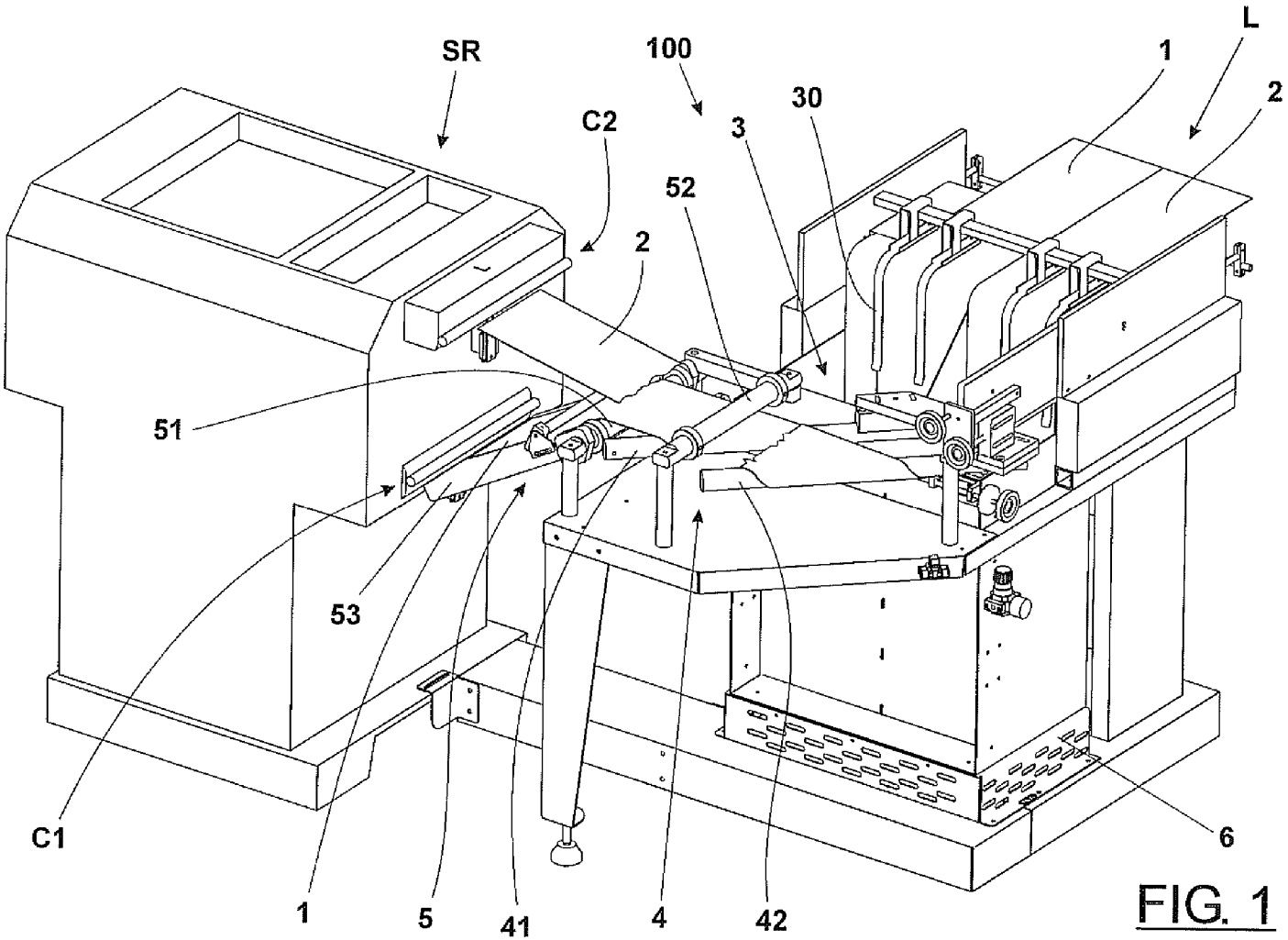
FIG. 1 illustrates an overall perspective view of the device of the invention and of a transversal cutting station, in accordance with a first embodiment of the method.
Figure 2:
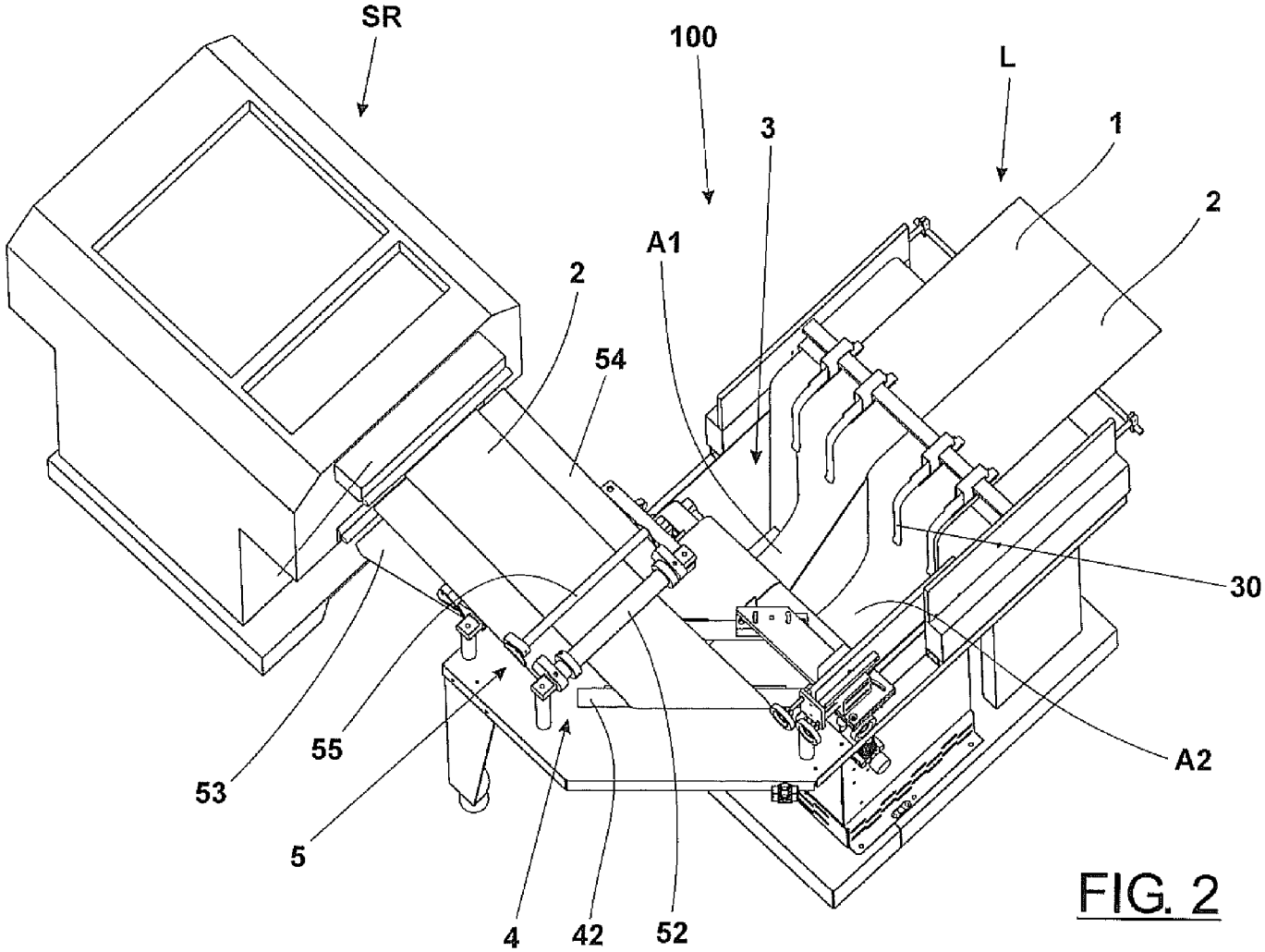
FIG. 2 illustrates, from above, the device and station of FIG. 1.

Elastic means 30 are provided in the inlet zone to the basin 3, destined to act on the strips 1, 2 such as to direct them downwards internally of the basin 3 (FIGS. 1, 2).

Air means 6 are associated to the basin 3, destined to act on the free loops A1, A2 in order to push them downwards.

Figure 3:
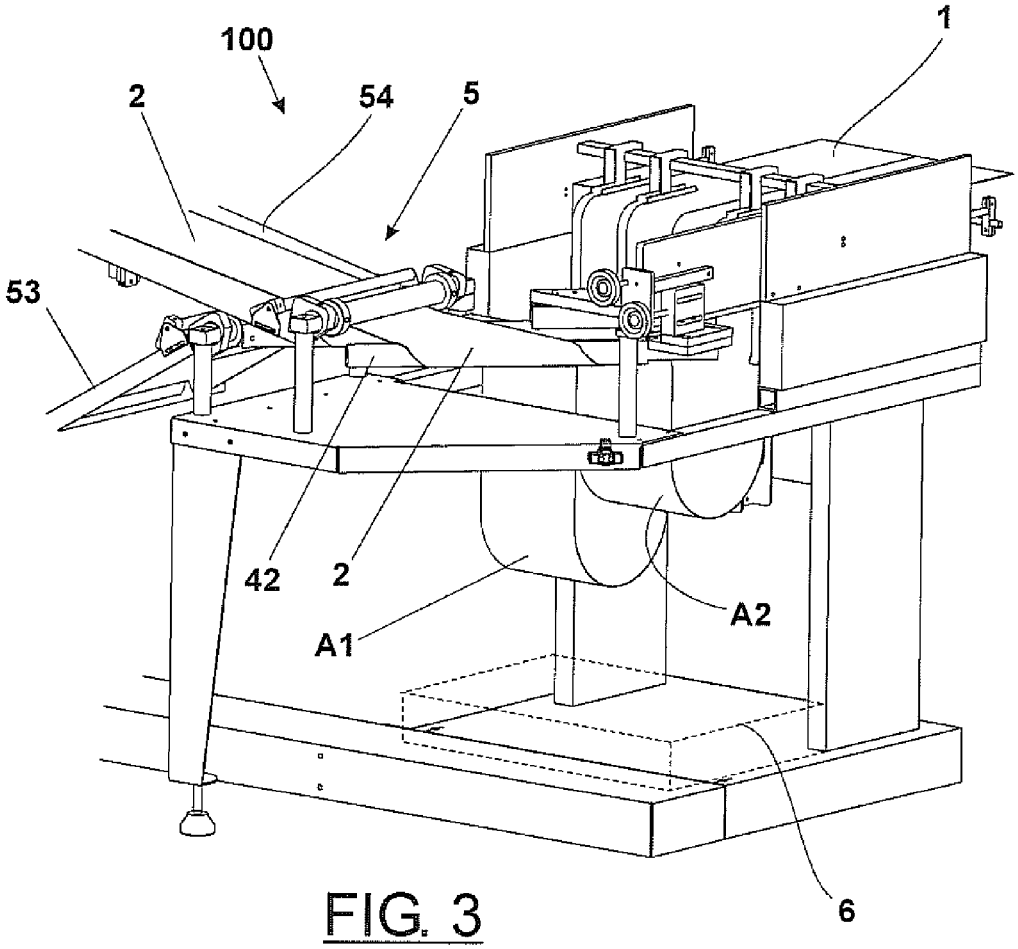
FIG. 3 illustrates a perspective view of the device similar to the view of FIG. 1, with some parts removed better to evidence others.

In a preferred embodiment, the air means 6 are positioned on the bottom of the basin 3 (see in particular FIG. 3) and are destined to generate a depression in the zone underlying the free loops A1, A2, such that the atmospheric pressure insisting on the upper part gives rise to the downwards pushing action.

Alternatively, the air means 6 are compressed-air type and comprise nozzles (not illustrated) positioned in the upper zone of the loops A1, A2 and orientated such that the air jet is facing downwards, towards the loops A1, A2.

The deviator organs 4 are constituted, for each strip 1, 2 by a rounded element 41, 42, arranged at 45° and destined to receive, on the external surface thereof, in sliding adherence, the respective strip 1, 2 which thus changes exit direction by 90° with respect to the infeed direction.

In the method, the rounded elements 41, 42 are both inclined in the same way such as to orientate the outlet branches of the strips 1, 2 on a same side (FIGS. 1, 2, 5).

Guide means 5 are provided downstream of the rounded elements 41, 42, which guide means 5 are destined to distance the strips 1, 2 by a predetermined amount in terms of height up to a predetermined amount, in accordance with the positions of the relative inlet channels C1, C2 in the transversal cutting station SR.

Figure 4:
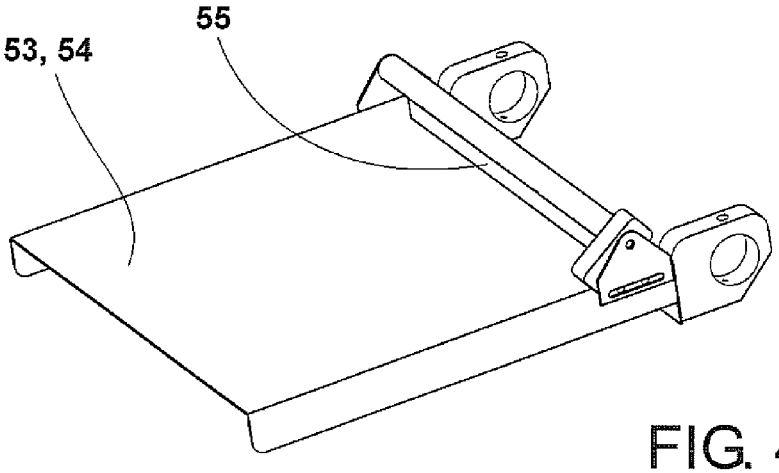
FIG. 4 illustrates a perspective view of a constructional detail of the device.

The guide means 5 comprise, for each strip 1, 2, an alignment roller 51, 52 associated to a sliding plane 53, 54 (FIGS. 2, 3); a bar 55 is advantageously provided above the sliding plane 53, 54, arranged transversally with respect to a relative strip 1, 2 and destined to superiorly abut the strip 1,2 with a slight smoothing friction, such as to flatten any irregularities (FIG. 4).

Figure 6:
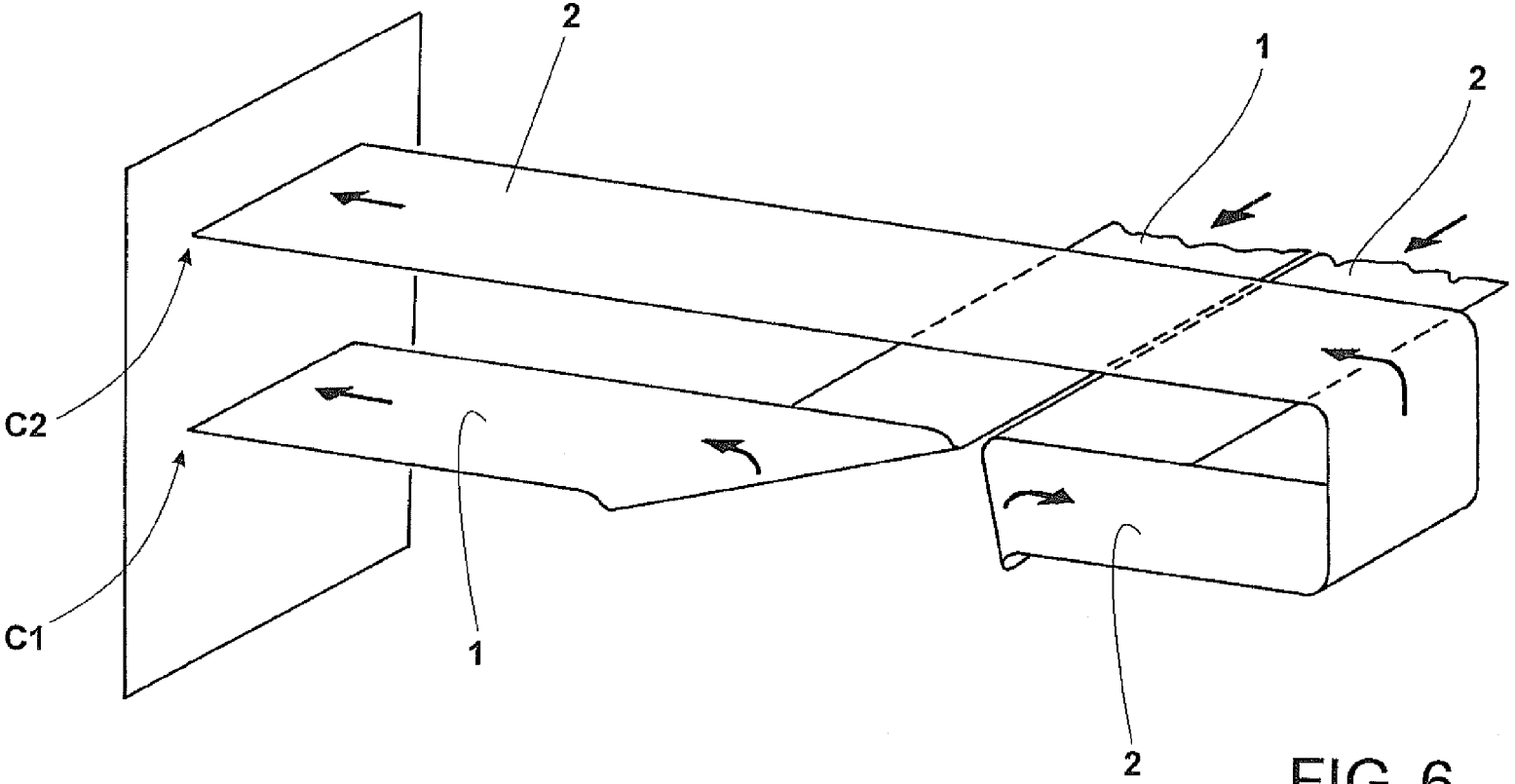
FIG. 6, in a similar view to that of FIG. 5, illustrates a further trajectory followed by the paper strips with a second embodiment of the method.

FIG. 6 illustrates a second embodiment of the method, which comprises, like the first embodiment, the definition of the free loops A1, A2 in the strips 1, 2, and the guided deviation thereof such as to arrange them with a transversal orientation.

Differently from the first embodiment, the deviation of each strip 1,2 is, in this case, performed on the opposite side, with an angle of 90° with respect to the direction of the arrival line L.

The strip 1, 2, which is centred horizontally with respect to the other, but directed in the opposite direction with respect to the transversal cutting station SR, is subsequently guided to perform a 180° inversion such as to maintain the centring and be directed towards the cutting station SR too.

The inversion by 180° is suitably calibrated such as to obtain the desired vertical staggering of the strips 1, 2, in accordance with the position of the inlet channels C1, C2.

Figure 7:
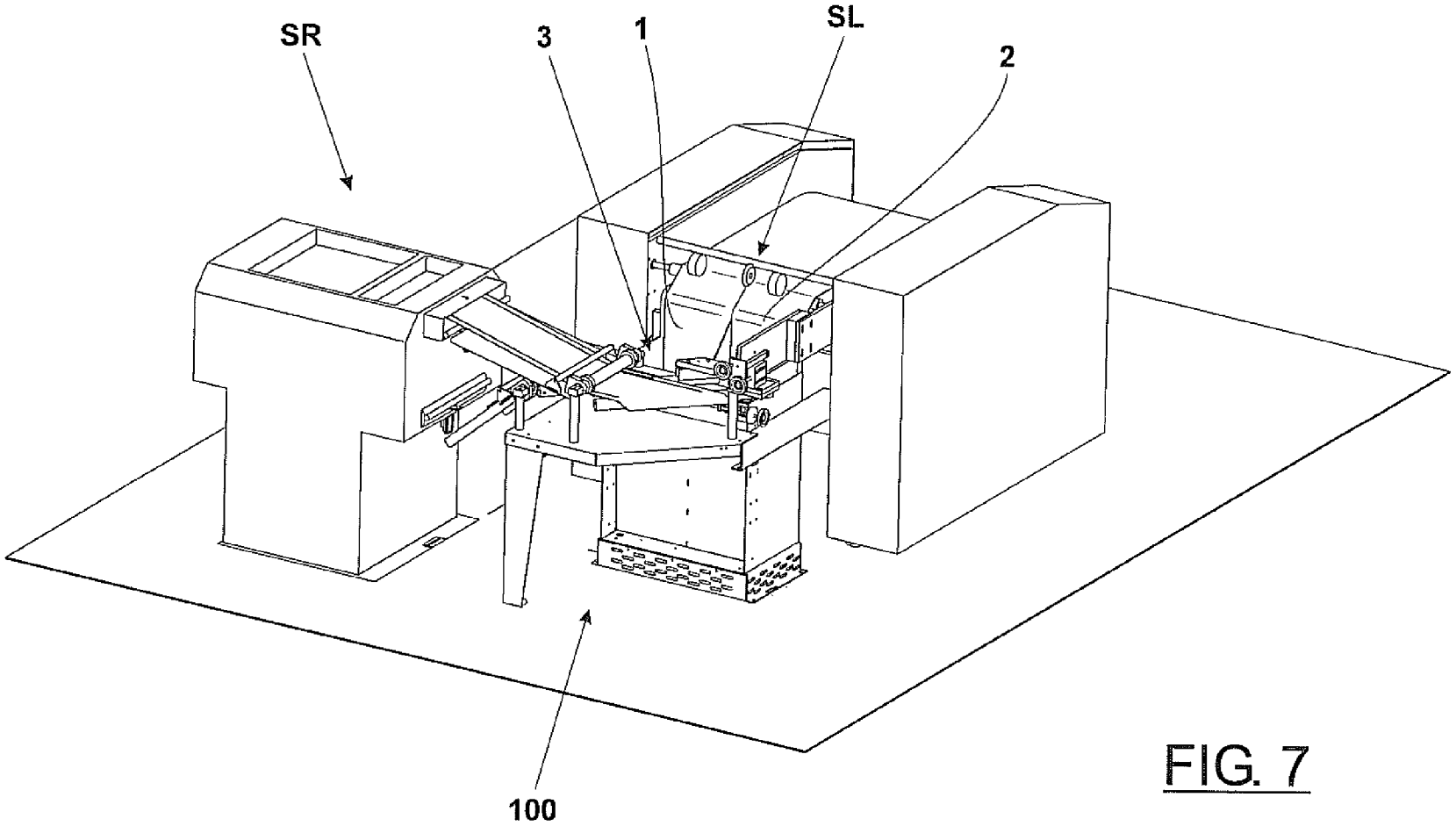
FIG. 7 illustrates a possible configuration of an automatic line which includes the device of FIG. 1.

FIG. 7 illustrates a possible configuration of an automated line which operates on a paper strip unwound from a reel, in the portion of the line comprised between the station for longitudinal cutting, mentioned herein above (not illustrated), the device 100 of the present invention and the transversal cutting station SR.

The conformation of the device 100 and the described modalities, according to which the device 100 brings the strips 1, 2 from flanked to superposed, without subjecting the strips 1, 2 to anomalous transversal stresses, enable elimination of the second loop buffers, provided downstream of the longitudinal cutting station for longitudinal cutting in the prior art solutions in the preamble.

The longitudinal cutting station of the strips 1, 2, denoted in FIG. 7 by reference SL, can thus be associated to the terminal part of the arrival line L, immediately upstream of the basin 3.

This configuration enables the overall size of the line to be considerably reduced.

The above is intended to be by way of non-limiting example, and any eventual modifications of detail are considered henceforth to fall within the ambit of protection defined by the following claims.

The invention claimed is:

1. A supply device for supplying at least two continuous strips to a transversal cutting station for cutting the strips, the strips being arranged side by side on an arrival line (L), the supply device comprising:

a basin (3), associated to a terminal part of the arrival line (L), adapted for interrupting a continuity of a support plane of the arrival line on which the at least two strips (1, 2) rest, such that each of the at least two strips (1, 2) entering the basin forms, by gravity, a free loop (A1, A2) in a downwards direction in the basin (3);

deviator organs (4), located downstream of the basin (3), adapted for guiding each of the strips (1, 2) for changing an orientation of one strip to a transversal orientation with respect to the arrival line (L), which one strip is horizontally centered with respect to the other strip (1, 2) and directed towards the transversal cutting station (SR).

2. The device of claim 1, wherein the deviator organs (4) are arranged at 45° with respect to the arrival line (L), such that an outlet direction of the strips (1, 2) is switched by an angle of 90° with respect to the arrival line (L).

3. The device of claim 1, wherein the deviator organs (4) are inclined to orientate outlet branches of the at least two strips (1, 2) on a same side.

4. The device of claim 1, wherein the deviator organs (4) comprise at least two rounded elements (41, 42), each adapted to slidingly adheringly receive a respective strip (1, 2) on an external surface thereof.

5. The device of claim 1, further comprising, downstream of the deviators (4), guide means (5) for arranging the at least two strips (1, 2) in a staggered fashion in terms of height in a tract preceding entry thereof into the transversal cutting station (SR).

6. The device of claim 5, wherein the guide means (5) comprise, for each strip (1, 2), an alignment roller (51, 52) associated to a sliding plane (53, 54).

7. The device of claim 6, further comprising a bar (55) arranged above each sliding plane transversally with respect to each strip, for abutting the strip (1, 2) with a slight sliding friction.

8. The device of claim 1, further comprising air means (6), adapted to act on the free loops (A1, A2) for pushing the loops (A1, A2) downwards.

9. The device of claim 8, wherein the air means (6) generate a depression in a zone underlying the free loops (A1, A2).

10. The device of claim 8, wherein the air means (6) are compressed air nozzles positioned in an upper zone of the loops (A1, A2) and orientated such that an air jet is directed downwards, towards the loops (A1, A2).

11. A method for supplying at least two continuous strips to a transversal cutting station for cutting the strips, the strips being supplied side by side on an arrival line (L), the method comprising:

forming by gravity a downwardly oriented free loop in each strip (1, 2) supplied from the arrival line (L);

guiding a deviation of each strip (1, 2) downstream of the loop (A1, A2) for arranging each strip with a transversal orientation that is predetermined with respect to the arrival line (L), such that each strip is centered horizontally with respect to each other strip (1, 2), with each strip directed towards a corresponding infeed of the transversal cutting station (SR).

12. The method of claim 11, wherein the deviation is effected at an angle of 90° with respect to the arrival line (L).

13. The method of claim 11, wherein the deviation is performed on a same side for each of the at least two strips (1, 2).

14. The method of claim 11, wherein the deviation is performed, for at least one of the strips (1, 2) on an opposite side with respect to the other strips.

15. The method of claim 11, further comprising arranging the at least two strips (1, 2) such that the at least two strips are vertically staggered in a tract before the at least two strips enter into the transversal cutting station (SR).

16. The method of claim 11, further comprising aerodynamically acting on the free loops (A1, A2), for pushing the free loops (A1, A2) downwards.

17. The method of claim 16, wherein the aerodynamic action is obtained by generating a low pressure zone underlying the free loops (A1, A2).

18. The method of claim 16, wherein the aerodynamic action is obtained by ejecting compressed air, directed from above in a downwards direction, into an upper zone of the free loops (A1, A2).

* * * * *